United States Patent [19]

Lamanna

[11] Patent Number: 4,597,577

[45] Date of Patent: Jul. 1, 1986

[54] GOLF CLUB ASSEMBLY SYSTEM AND METHOD

[76] Inventor: Anthony Lamanna, 24 N. 38 Valley Rd., Lake Zurich, Ill. 60047

[21] Appl. No.: 680,475

[22] Filed: Dec. 11, 1984

[51] Int. Cl.[4] ..... A63B 53/02

[52] U.S. Cl. ..... 273/80.1; 273/80.2

[58] Field of Search ..... 273/80.1, 80.2–80.9, 273/81.2, 183 D

[56] References Cited

U.S. PATENT DOCUMENTS

| | | | |
|---|---|---|---|
| 796,802 | 8/1905 | Brown | 273/80.1 |
| 1,623,523 | 4/1927 | Bourke | 273/80.1 |
| 3,170,691 | 2/1965 | Pritchard | 273/80.5 |
| 3,848,874 | 11/1974 | Elkins | 273/183 D X |

*Primary Examiner*—George J. Marlo

*Attorney, Agent, or Firm*—Trexler, Bushnell & Wolters, Ltd.

[57] ABSTRACT

A golf club assembly system is provided for a golf club including, a shaft having a grip at one end and an opposite free end, and a club head having a hosel affixed to the shaft by a bonding agent, the grip preferably having indicia for alignment with a predetermined portion of the club head. The assembly system comprises: a projecting pin on either the hosel or the shaft free end, and a slot on the other of said hosel or shaft free end for receiving the pin. The slot includes a circumferential stop defining a maximum relative rotational movement in one direction between the shaft and head, and said slot also defining the axial position of the club head on the shaft. The pin and the slot are located on the shaft and hosel for causing the intended alignment of the shaft and for the grip indicia with the intended portion of the club head when the pin is fully advanced with respect to the slot means in both the axial and circumferential directions. The pin and slot joint substantially prevents rotation of said club head in response to forces normally encountered thereby when striking a ball, and also prevents inadvertent disengagement of the club head should the bonding agent fail, which bonding agent provides the primary means for affixing the club head to the shaft. There is also disclosed a method of assembly in accordance with the system and structure described above.

13 Claims, 7 Drawing Figures

GOLF CLUB ASSEMBLY SYSTEM AND METHOD

BACKGROUND OF THE INVENTION

The present invention is directed to a novel golf club assembly system including a novel method and novel structure for facilitating assembly of a golf club head to a golf club shaft.

The prior art presents numerous methods for assembling golf clubs. However, most of these methods are directed to assembly in a factory by a manufacturer of golf clubs, for sale in the assembled condition. Today golf clubs are available with a wide variety of club head configurations, as well As with varying shaft designs and stiffness. As such, it will be seen that providing every possible combination thereof requires the production and maintenance of a very large inventory or supply of golf clubs to meet all possible customer needs.

Such golf clubs are custom assembled to customer specifications. However, this involves a considerable length of time in processing orders to the factory, as well as considerable expense in factory operation on such a custom basis. Alternatively, many pro shops, sporting goods stores, retail stores and the like provide such custom assembly service utilizing a stock or inventory of individual shafts and heads of different kinds and types, and assembling selected heads and shafts to customer specifications. This greatly reduces the amount of inventory necessary as well as making custom assembly available on a relatively convenient and less expensive basis. However, most such sporting good stores and pro shops are not equipped with special assembly machinery and equipment required, and often do not employ skilled assembly personnel. Moreover, the purchase of such specialized equipment and employment of such specially trained personnel greatly increases the cost of such customized assembly service.

The prior art has devised a number of simplified assembly methods, primarily involving assembly of a shaft with a hosel portion of a club head utilizing only a bonding agent such as an epoxy resin, or the like. That is, the shaft end which is dimensioned to slideably interfit within the club head hosel is coated with a quantity of a selected adhesive or bonding agent and the parts are then interfitted permitting the bonding agent to cure and effect a bond therebetween. However, as previously mentioned, most such pro shops or retail sporting good shops are without specialized personnel or equipment for carrying out this operation. Hence, they are fearful that the bond thus effected may for some unforeseen reason fail in service, causing inconvenience as well as possible injury. Such separation of head and shaft after assembly would be damaging to the reputation of the shop, and might also subject the shop to personal injury claims.

Accordingly, it is desirable to provide a reliable, and preferably mechanical means of effecting club head-to-shaft assembly, still without requiring specialized tools or equipment, or specialized training on the part of the assembler.

The prior art envisions a number of arrangements for mechanical assembly of golf club head and shaft's; however, most of these have involved relatively complex and difficult to manufacture pieces, sub-assemblies, and the like, or require a relatively complex and difficult process of assembly. Additionally, the prior art also discloses a number of interchangeable shaft and club head assemblies. However, by their nature, these assemblies are readily disassemblable or interchangeable, and thus, they lack the degree of permanence and rigidity desired of custom assembled golf clubs, to which the present invention is directed.

Some of these prior art assembly arrangements utilize a threaded engagement of the shaft with the hosel. However, such engagement provides no means to limit relative rotation between shaft and head. This design does not permit preassembly of the shaft with a grip bearing indicia for alignment with a predetermined portion of the club head, as is desired in many golf club designs. That is, since the threaded engagement provides no predetermined stop or fully advanced position with respect to relative rotation, it is not possible to attain proper alignment of the indicia on the preassembled grip with the club head when utilizing threaded engagement with the shaft. Moreover a threaded connection permits rotation of the head relative to the shaft when the ball is struck. In addition to resulting in ineffective striking of the ball and unsuitable performance the threaded type of connection also permits further advancement of the shaft into the hosel portion of the head. Such further advancement may cause undue stress forces to build within the hosel, ultimately resulting in failure or splitting of the hosel or club head, this problem is especially acute where wood type club heads are involved.

OBJECTS AND SUMMARY OF THE INVENTION

Accordingly, it is a general object of the invention to provide novel and improved system and a related method for assembly of a golf club.

A related object is to provide such a system which is relatively simple and inexpensive in its manufacture, simple to assemble, and yet provides an assembled golf club which is highly reliable in use.

A further related object is to provide such a system and method for assembly of a golf club, which requires no specialized tools or training.

In accordance with one aspect of the invention, there is provided a golf club assembly system for a golf club including, a shaft having a grip at one end and an opposite free end, grip indicia thereon for alignment with a predetermined portion of a club head, and a club head having a spaced hosel design. The assembly system comprises a primary connection, preferably in the form of a bonding agent, and a secondary connection in the form of a projecting pin means on one of said hosel or said shaft free end, and slot means on the other of said hosel or said shaft free end for receiving said projecting pin means therein; said slot means including circumferential stop means defining a maximum relative rotational movement in a given direction between said shaft and said head. The pin means and slot means are respectively located on one or the other of said shaft and said hosel, such that when the pin is engaged with the slot stop means, alignment of the grip indicia with a predetermined portion of the club head is attained in both the axial and circumferential directions. Further, said circumferential stop means substantially prevents rotation of said club head in response to forces normally encountered thereby when striking a golf ball. This resistance to rotational forces serves to prevent the primary connection from failing in service, while the pin and slot also insure that the club head will not become inadvertently dislodged from the shaft.

In accordance with another aspect of the invention, there is provided a method of assembling a golf club including a head and a shaft, said shaft having a grip preassembled with one end thereof and an opposite free end; said grip including indicia for alignment with a predetermined portion of said head, and said head having a hosel for receiving said shaft. The said method comprises the steps of attaching a pin to one of the shaft free end or the hosel; forming a slot on the other of the shaft free end or the hosel for receiving the pin and for preventing both further axial movement between the head and the shaft and further rotational movement of the head in response to forces normally encountered while striking a ball; applying a quantity of bonding material to at least one of said hosel or said shaft free end; and aligning and engaging said pin with said slot for maintaining said head in position on said shaft while said bonding material hardens.

Still another aspect of the invention involves the use of a set screw in place of the normal epoxy bonding agent. This modified form of the invention provides an assembly system that allows quick and reliable interchangability of club heads and shafts. More specifically, there are two areas where this is important. The first area involves the fitting of clubs to a players specification and preference. The second area involves the provision of golf clubs for younger or junior players, and the ability to change shafts as the player grows, matures and becomes stronger. With this modified form, the club head is not bonded to the shaft, rather a set screw is used as the primary mode of connection, with the pin and slot configuration maintaining alignment and also providing a safety factor should the set screw fail. Thus, when fitting clubs to a players specification, the club heads and shafts can be readily interchanged. Also, with regard to junior players, as the player grows and becomes stronger, the shafts may be replaced and the club heads salvaged.

BRIEF DESCRIPTION OF THE DRAWINGS

The features of the invention which are believed to be novel are set forth with particularity in the appended claims. The organization and manner of the operation of the invention, together with further objects and advantages thereof, may best be understood by reference to the following description taken in conjunction with the accompanying drawings in the several figures of which like reference numerals identify like elements, and in which:

DETAILED DESCRIPTION OF THE ILLUSTRATED EMBODIMENT

Figure 1:
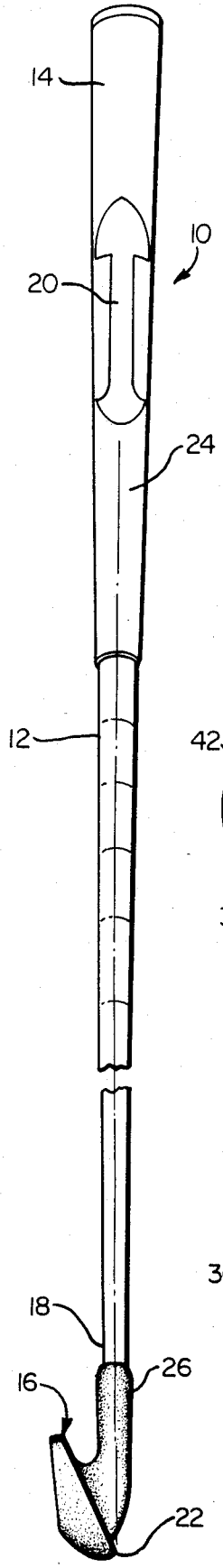
FIG. 1 is a perspective view of a golf club assembled in accordance with the present invention.
Figure 2:
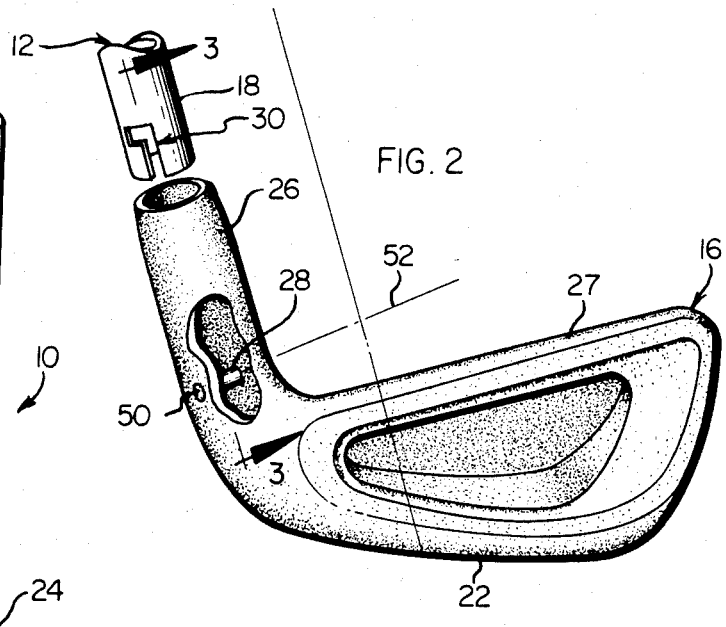
FIG. 2 is an enlarged, exploded perspective view, partially broken away and illustrating details of the structure of the invention.

Referring now to the drawings and initially to FIG. 1, a golf club assembled in accordance with the method and system of the invention is designated generally by the reference numeral 10. This golf club 10 includes a shaft 12 having a grip 14 preferably preassembled with one end of the shaft and a club head 16 assembled with an opposite end 18 of said shaft. Reference is invited also to FIG. 2, wherein the end 18 of shaft 12 is illustrated as a free end thereof, that is, prior to its assembly with the club head 16. The head 16 has generally hollow, tubular hosel portion 26 for receiving the free end 18 of shaft 12. In accordance with the illustrated embodiment, the grip 14 includes indicia 20 which is to be aligned with a predetermined portion of the club head 16 when the shaft 12 is assembled therewith. In particular, it is desirable that when the golf club 10 is assembled, that a sole edge portion 22 of the head 16 be in alignment with the indicia 20. This alignment is indicated in FIG. 1, generally by a datum line 24. In this regard, the club head 16 includes a club face or striking portion 27 which extends generally downwardly and outwardly of the hosel 26, this striking portion including the sole edge 22.

In accordance with the assembly method and system of the invention, projecting pin means, which here takes the form of a pin 28, is formed on either the hosel 26 or the shaft free end 18. Cooperating slot means, which in the illustrated embodiment takes the form of a slot 30, is formed on the other of the hosel or shaft free end for receiving said pin 28. In the embodiment illustrated the pin 28 is attached to the hosel and the slot 30 is formed in the shaft free end 18.

Advantageously, the slot 30 is formed for preventing or limiting both further axial movement between the head 16 and the shaft 12, and also for preventing further rotational movement of the head in response to forces normally encountered when the club head strikes a ball. As best viewed in FIG. 3, it will be seen that the shaft 12 comprises a hollow tubular shaft and the slot 30 comprises a generally L-shape configuration. In this regard, a first or axial slot portion 32 extends from a free outer end of the shaft in a generally axial direction, while a second or circumferential slot portion 34 is formed continuously from the first slot portion and extends generally at right angles thereto in a circumferential direction on the shaft 12.

Accordingly, during assembly, the free outer end 18 of shaft 12 is inserted into the hosel 26 so that the axial portion 32 of the slot 30 is aligned with and engages the pin 28. Thereafter, the shaft is further advanced axially until the pin 28 bottoms in slot 30. Thereafter, the shaft and head are rotated relative to each other to cause the pin 28 to advance into abutment with an end wall 36 of circumferential slot portion 34. In this regard, the lateral dimensions of both slot portions 32 and 34 are similar to the diameter of pin 28. Accordingly, it will be seen that slot portion 34 and end wall 36 thereof define a retaining portion for retaining the pin so as to preclude relative movement between the shaft and head in the axial direction with respect to the shaft. Moreover, the end wall 36 defines the circumferential stop means for defining the maximum relative rotational movement in this direction between the shaft and the head, which as discussed herafter facilitates alignment of the club head 26 with the grip indicia 20.

Prior to disposition of the free end 18 of shaft 12 in the hosel 16 a quantity of bonding agent 38 is applied to either the shaft end or the hosel inner bore. Next, the slot 30, and pin 28 connection are engaged, and the shaft and club head are rotated relative to each other to bring the pin 28 into engagement with the end or abutment wall 36. This rotative movement serves to properly align the club head preparatory to application of the bonding agent 38 and while said bonding agent is in an uncured state. Once cured the bonding agent 38 provides the primary holding or assembly means for maintaining the shaft and club head in assembly should the bonding agent 38 not cure properly or fail after a period of use, the interconnection or joint attained with slot 30 and pin 28 will prevent the club head from becoming disengaged during use, and possibly "flying off" and causing injury.

Figure 4:
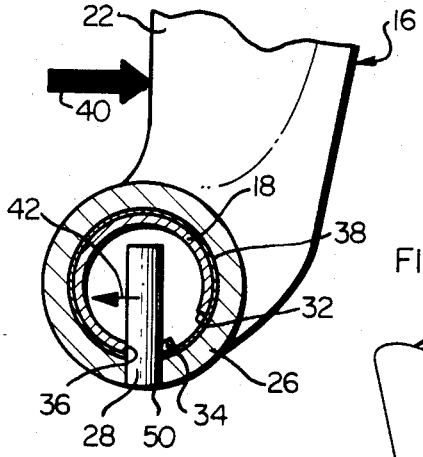
FIG. 4 is a sectional view of the assembled golf club of FIG. 3 taken generally in the plane of the line 4—4 thereof.

Referring briefly to FIG. 4, and as previously noted, engagement of pin 28 with slot wall 36 is such as to resist rotation of the club head relative to the shaft in response to forces encountered while striking a ball. Such a force and its direction are indicated in FIG. 4 generally by arrow 40. It will be recognized that this force 40 will cause a corresponding force 42 at the pin 28 which is resisted by the end wall 36 defining the circumferential stop and the limit or extent of slot portion 34.

As a further feature of the invention, both the pin 28 and the slot 30 are respectively located or rotatably positioned on the hosel and shaft for achieving alignment of the indicia 20 with the sole edge 22 of the club when the pin 28 is fully advanced with respect to the slot 30 in both axial and circumferential directions. That is, when the club is fully assembled as shown in FIG. 1, with the pin 28 engaged with end wall 36, the indicia 20 on the grip 14 will be aligned properly with sole edge 22, as indicated by datum line 24.

With the preferred embodiment of the invention illustrated in FIGS. 1 through 4, the pin 28 extends radially inwardly of the hosel 26. In accordance with a preferred method of construction, the attachment of the pin in this fashion further includes boring a through aperture 50 in the hosel for receiving the pin 28, inserting the pin 28 through this through aperture 50 and thereafter cutting or grinding smooth any remaining portion of the pin protruding outwardly of the aperture 50 such that the pin is flush with the outer surface of the hosel. Thus, with the method of the present invention, the aperture 50 is bored in a predetermined alignment with the sole edge 22 so as to achieve the desired alignment of the pin therewith and subsequent alignment of the grip indicia 20 with said sole edge. In the illustrated embodiment, this alignment is such that the pin extends transversely to the line 24 which extends intermediate the indicia 20 and sole edge 22, as generally indicated in FIG. 2 by line 52. Moreover, the pin 28 and aperture may be sized for a pressfit therebetween, or the pin may be secured by a quantity of bonding material (not shown) or by brazing or welding.

Advantageously, the foregoing method of assembly may also be employed with a wood-type head, rather than with the iron-type head illustrated in the drawings. This method and system of assembly is particularly advantageous with respect to a wood-type head, as it permits the head to be prefinished, that is, stained and varnished as desired, prior to assembly with the shaft. Hence, the method of the invention also contemplates finishing a wood-type head prior to assembly of the head with the shaft.

Figure 3:
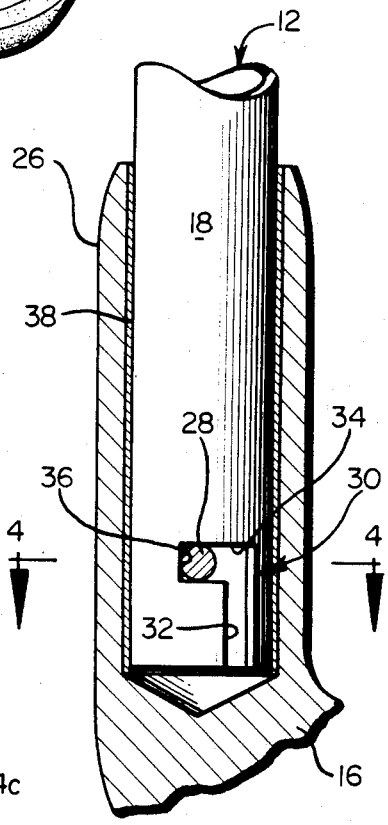
FIG. 3 is an enlarged view, partially broken away and partially in section, taken generally along the line 3—3 of FIG. 2, but illustrating the golf club in assembled condition, as in FIG. 1, in accordance with the invention.
Figure 6:
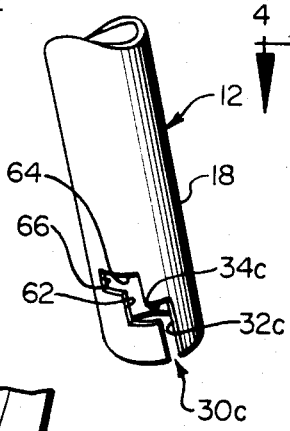
FIG. 6 is an end perspective view of a shaft free end portion of an unassembled golf club showing a further alternative form of the invention.
Figure 5:
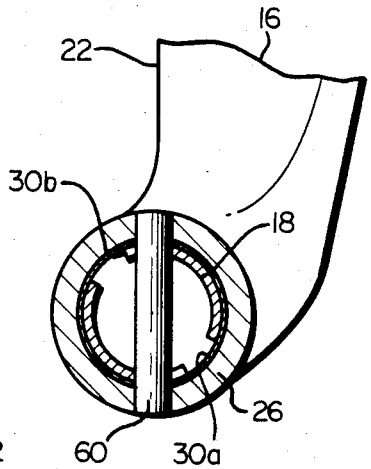
FIG. 5 is a sectional view similar to FIG. 4 and illustrating an alternative form of the invention.

Referring now also to FIGS. 5 and 6, two alternative forms of construction in accordance with the invention are illustrated. Initially, FIG. 5 illustrates a similar club head 16 having a hosel 26 for receiving an end 18 of a shaft. However, a pair of similar diametrically opposed slots, designated **30*a* and 30*b*, are provided in the shaft end 18. Preferably, these slots are generally L-shaped and of the general form of slot 30, as illustrated in FIG. 3. Accordingly, a pair of similar pins 28 may be provided, or alternatively, as illustrated in FIG. 5, a single elongate pin 60 traversing the diameter of the hosel in the same orientation as pin 28 with respect thereto, may be utilized for engagement with both of the slots 30*a* and 30*b*. It will be understood that the first slot 30*a* will be aligned with respect to indicia 20 in the same fashion as slot 30, with second slot 30*b*** being diammetrically opposed.

Referring now to FIG. 6, in accordance with still another alternative form of the invention, the slot 30 may comprise a pair of continuously formed L-shaped slots as indicated generally by reference numeral **30*c*. In this regard, the alternative slot illustrated in FIG. 6 includes an additional or second axial portion 62 formed continuously with an end of a circumferential portion 34*c* opposite the first axial portion 32*c* so as to extend axially further in the direction of the grip 14. This second axial portion 62 will then be substantially coaxial with but circumferentially offset from the first axial portion 32*c*. An additional or second circumferential portion 64 is also provided extending from the end of the second axial portion and in the same direction as the first circumferential portion 34*c*. Hence, the second circumferential portion is generally axially spaced from first circumferential portion 34*c*. Accordingly, the above-mentioned stop portion is provided by an end wall 66 of second circumferential slot portion 64 in the embodiment illustrated in FIG. 6**.

It will be understood that the slot **30*c* will be aligned relative to indicia 20 such as to obtain proper alignment relative to the sole edge 22 when pin 28 abuts end wall 66. In this regard, the combined axial extent of slot portions 32*c* and 62*c* will be the same as the axial extent of slot portion 32. Alternatively, pin 28 may be placed at a lesser depth relative to hosel 26 to coincide with the combined axial extent of slots 32*c* and 62**.

Figure 7:
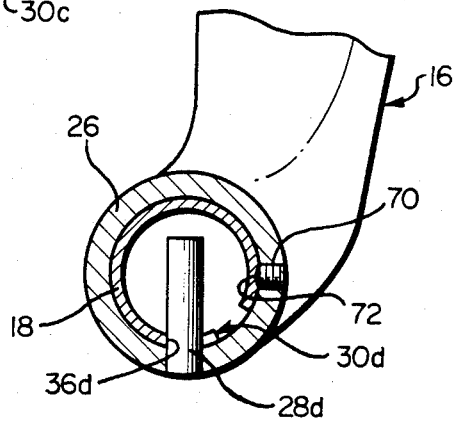
FIG. 7 is also a view similar to FIG. 4 and illustrating still another modified form of the invention.

Attention is now directed to FIG. 7. The embodiment of FIG. 7 differs from those as discussed above, in that a set screw, rather than a bonding agent, is employed as the primary mode of connecting the club head to the shaft. In this regard, the shaft end 18 includes a slot **30*d*, while the club head 16 includes both a pin arrangement 28*d* and a set screw 70. The pin 28*d* is disposed in the slot 30*d* to effect initial assembly of the club head 16 to the shaft end 18. As discussed above, the pin and slot arrangement achieve proper alignment of the club head with the shaft and also controls the depth to which the shaft end 18 is disposed within the hosel 26. Thereafter the set screw 70 is used to affix the club head 16** to the shaft.

As can be appreciated, should the set screw 70 become loose or fail in use, the pin and slot assure that the club head will not inadvertently become dislodged. Also, in use the pin **28*d* will be engaged against the end wall 36*d* of the slot 30*d*, and this engagement will accommodate the forces tending to rotate the club head relative to the shaft when a ball is struck. Thus, the pin and slot engagement serve to resist relative movement between the shaft 18 and the club head 22. As can be appreciated, for the set screw 70 to be effective the point 72 thereof must penetrate or bite into the shaft 18**. Once engaged, rotational forces will tend to destroy the desired biting engagement and cause the connection to strip or otherwise fail. With the present invention, the secondary pin and slot connection accommodate all rotational forces and thus prevent failure of the set screw connection.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiments and specific constructions described herein but should be defined by the appended claims and equivalents thereof. Accordingly, the aim of the appended claims is to cover all such changes and modifications as fall within the true spirit and scope of the invention.

The invention is claimed as follows:

1. A golf club assembly including a shaft having a free end, and a club head having a hosel having a hollow bore, said assembly comprising: primary mounting means for affixing said club head to said shaft, and secondary mounting means for effecting initial assembly of said club head and shaft, said secondary mounting means including projecting pin means on said hosel extending inwardly of the hosel bore and slot means on said shaft free end for receiving said projecting pin means therein; said slot means including a generally axially extending portion opening to the end of the shaft and a circumferentially extending portion terminating in an end wall providing circumferential stop means defining a maximum relative rotational movement in one direction between said shaft and said head; said pin means and said slot means being respectively located for causing alignment of said shaft with said club head when said pin means is fully advanced with respect to said slot means in both the axial and circumferential directions; and said circumferential stop means substantially preventing rotation of said club head in response to forces normally encountered thereby when engaging a ball, and thereby serving to maintain said primary mounting means in operable condition and said primary mounting means preventing relative rotation and axial movement of said club head and said shaft as required to unseat said pin means from said slot means after assembly.

2. An assembly system according to claim 1 wherein said primary mounting means is a bonding agent.

3. An assembly system according to claim 1 wherein said primary mounting means is a set screw.

4. A golf club assembly including: a hollow shaft member having a first end portion, a slot cut in said first end portion and opening to the end of the shaft, said slot including a generally axially extending portion opening to the end of the shaft and a generally circumferentially extending portion which terminates in an end wall providing abutment means; a club head attachable to said first end portion of the shaft, said club head including a hosel portion which further includes a hollow bore for receiving said shaft first end portion, a projecting pin member carried by said hosel and extending into said bore, such that said pin may be engaged in said slot and the club head rotated to bring said pin into engagement with said abutment means, said engagement defining the limit of relative rotatable movement between said club head and shaft in a first circumferential direction, to align said club head with said shaft and further to prevent rotation of the club head in said first circumferential direction in response to forces normally encountered when a ball is struck, and means for preventing relative axial movement and rotation of said club head relative to said shaft in a second circumferential direction, opposite to said first direction once said club head is assembled.

5. A golf club assembly according to claim 4 wherein said shaft includes a grip assembly thereto at an end opposite said first end portion, said grip having indicia thereon for alignment with a predetermined portion of said club head, and said pin member and said slot being positioned such that when said pin engages said abutment means for grip indicia are aligned with said predetermined club portion.

6. A golf club assembly according to claim 4 wherein said club head includes a striking portion extending downwardly and outwardly of said hosel, said club head including a sole edge, and said pin member being aligned within said hosel substantially in the direction of extrusion of said sole edge from said hosel such that a projection of said pin into the plane of said sole edge is substantially parallel to said sole edge.

7. A golf club assembly according to claim 4 wherein a pair of diametrically opposed similar slots are provided in said shaft and portion, and wherein said pin member comprises an elongated pin traversing the diameter of said hosel for engagement with both of said slots.

8. A golf club assembly according to claim 4 wherein a pair of diametrically opposed pins are provided, each extending inwardly of said hosel, and wherein a pair of similar slots are provided in said shaft end portion, each including respective diametrically opposed axial and circumferential portions for receiving the respective diametrically opposed pins.

9. A golf club assembly according to claim 4 wherein said slot further comprises a second axial portion formed continuously with an end of said circumferential portion opposite the first axial portion so as to extend axially further along said shaft, and parallel to and circumferentially spaced from the first axial portion, and a second circumferential portion extending from said second axial portion in the same direction as said first circumferential portion so as to be axially spaced from said first circumferential portion.

10. A golf club assembly according to claim 4 wherein said means for preventing relative rotation and axial movement between said shaft and club head comprises a quantity of bonding material intermediate an outer surface of said shaft and an inner surface of said hosel bore.

11. A golf club assembly according to claim 4 wherein said means for preventing relative rotation and axial movement between said shaft and club head comprises a set screw carried by said hosel and engaging said shaft.

12. A method of assembling a golf club which includes a club head and a shaft, with said club head having a hollow hosel defining a hosel bore for receiving the shaft, said method comprising the steps of: providing a pin member on said hosel which extends inwardly into said hosel bore; providing a slot in the end of the shaft to be engaged in said hosel which slot includes a first axially extending portion and a second circumferentially extending portion terminating in stop means; applying a quantity of bonding agent to one or the other or both said shaft end and said hosel bore prior to engagement of said shaft end in said hosel bore; engaging said slotted end of the shaft in said hosel bore and effecting relative rotation between said club head and shaft to dispose said pin member in said slot and in engagement with said stop means, thereby initially aligning said club head with said shaft; and permitting said bonding agent to cure to fix said club head and shaft against both relative axial and rotational movement.

13. A method according to claim 12 further including the steps of: providing a grip on the end of the shaft prior to assembly with said hosel wherein said grip includes indicia for alignment with a predetermined portion of the club head; and selecting the circumferential positions for said pin and slot such that when the pin and slot are engaged with the pin abutting the slot end wall said grip indicia and club head portion are properly aligned.

* * * * *